United States Patent [19]

Goodlaxson

[11] 4,087,994

[45] May 9, 1978

[54] CENTRIFUGAL PUMP WITH MEANS FOR PRECLUDING AIRLOCK

[75] Inventor: John D. Goodlaxson, Colfax, Iowa

[73] Assignee: The Maytag Company, Newton, Iowa

[21] Appl. No.: 720,692

[22] Filed: Sep. 7, 1976

[51] Int. Cl.[2] ..... F01D 5/14; F03B 3/12; D06F 35/00

[52] U.S. Cl. ..... 68/23.7; 415/143; 415/213 R; 415/215; 416/188

[58] Field of Search ..... 415/213 R, 143, 215; 416/185, 188, 186; 68/23.6, 23.7, 184

[56] References Cited

U.S. PATENT DOCUMENTS

| | | | |
|---|---|---|---|
| 2,566,795 | 9/1951 | Egger | 416/186 R |
| 2,850,984 | 9/1958 | Shiley et al. | 415/213 R X |
| 2,961,862 | 11/1960 | Smith | 68/184 X |

FOREIGN PATENT DOCUMENTS

| | | | |
|---|---|---|---|
| 1,126,250 | 3/1962 | Germany | 415/213 R |

*Primary Examiner*—C. J. Husar
*Assistant Examiner*—Donald S. Holland
*Attorney, Agent, or Firm*—Richard L. Ward

[57] ABSTRACT

A centrifugal pump having an impeller with a fingerlike projection on each blade extending radially outward from the impeller body into the outer annulus of the pumping chamber. These projections cut through the liquid that has been centrifuged to the outer annulus causing a turbulence which draws a portion of the liquid into the body of the impeller for mixing with trapped air. This mixing action causes the air to be centrifuged with the liquid and alleviates air locking in the pump and is especially valuable in a laundry washing machine where, in the last portion of the liquid extraction cycle, air and soap bubbles are likely to be included in the liquid.

11 Claims, 3 Drawing Figures

CENTRIFUGAL PUMP WITH MEANS FOR PRECLUDING AIRLOCK

BACKGROUND OF THE INVENTION

1. Field of the Invention

This invention relates generally to the field of centrifugal pumps and more specifically to a centrifugal pump which alleviates or eliminates air locking.

2. Description of the Prior Art

Prior art centrifugal pumps applied to washing machines have a tendency to air lock when soapy water is pumped as during the extraction portion of the cycle. Because of the nature of a centrifugal pump, the liquid is centrifuged to the outer part of the pump cavity whereby an inner and outer annulus of air and liquid, respectively, is formed which causes at least a partial or intermittent loss of flow. One prior art disclosure for preventing this air lock problem includes venting the pump. A specific construction of this type is disclosed in U.S. Pat. No. 2,873,598.

SUMMARY OF THE INVENTION

It is an object of the instant invention to provide an improved centrifugal pump.

It is a further object of the instant invention to provide a centrifugal pump which will tend to clear an air lock condition.

It is a still further object of the instant invention to provide a centrifugal pump with projections on the impeller blades for mixing liquid and air to alleviate air lock conditions.

These objects are achieved in a centrifugal pump for an apparatus where the centrifugal pump is disposed for receiving liquid from a liquid container. The centrifugal pump is driven by a drive motor. The pump impeller receives liquid and centrifuges it outwardly toward the pump outlet. At least one impeller blade has a fingerlike projection extending outwardly from the body of the impeller into the annular body of liquid, which has been outwardly centrifuged away from the impeller for creating turbulence to effectively draw a portion of the liquid back into the impeller body. The liquid which is drawn into the impeller is mixed with air or bubbles, if any are present, and then centrifuged outwardly. This mixing action serves to relieve an air lock in the pump.

Operation of the device and further objects and advantages thereof will become evident as the description proceeds and from an examinaton of the accompanying two pages of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
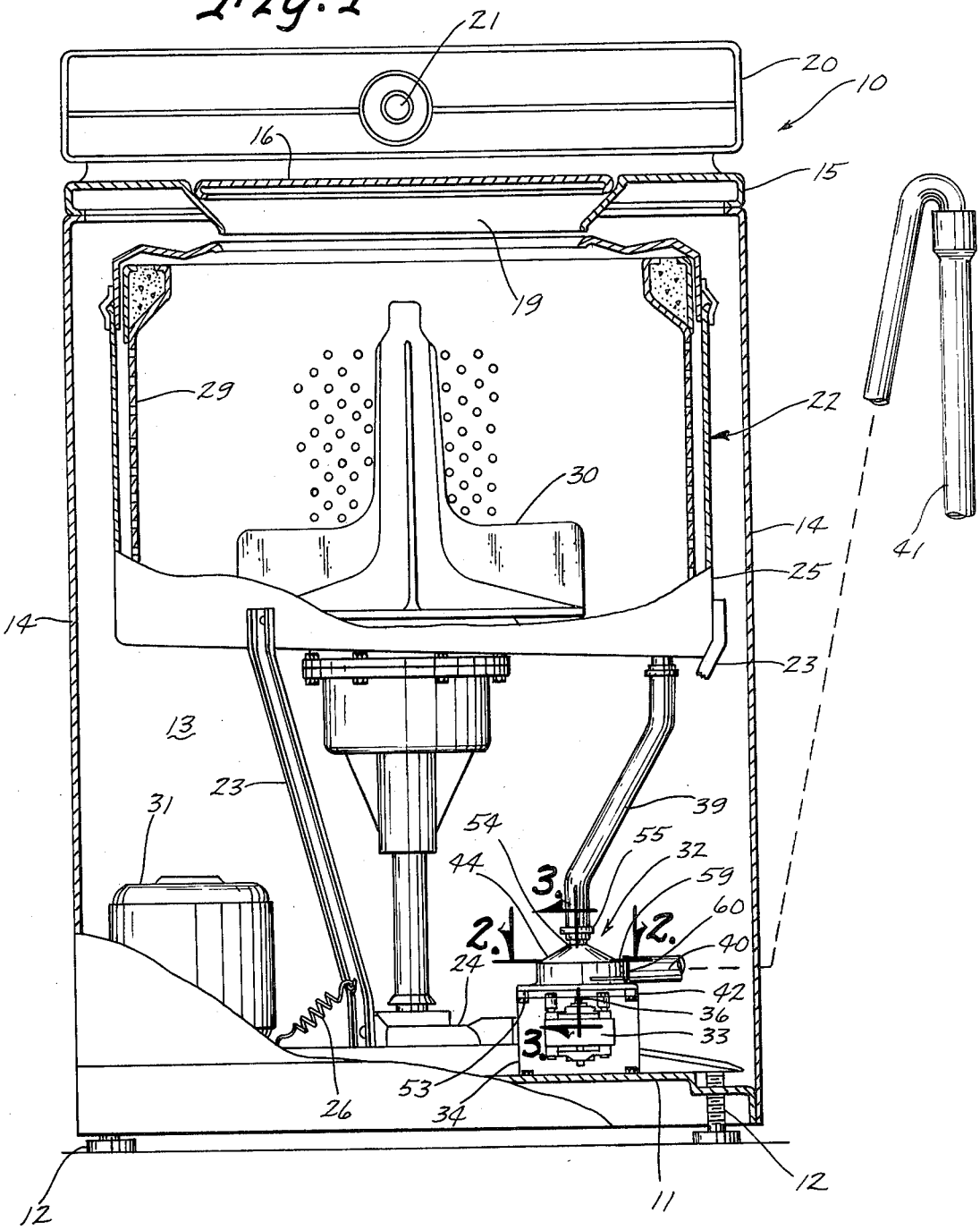
FIG. 1 is an overall view of an automatic washing machine with portions broken away to show various components including the improved centrifugal pump of the instant invention.

Referring now to FIG. 1, there is shown an automatic washing machine 10 including a base frame 11 supported on a plurality of adjustable legs 12 and mounting a cabinet 13 comprising sidewall portions 14 and a top cover portion 15. The top cover portion 15 includes a hinged door panel 16 normally covering a recessed loading opening 19 and further includes an upwardly extending housing 20 for accommodating various control members such as programming means actuatable by the dial 21.

Mounted within the cabinet 13 is a tub assembly 22 nutationally supported on the base frame 11 by an inverted tripod arrangement including tub braces 23 which are connected at the lower end to a support member 24 positioned on the base frame 11. The tub braces 23 are connected at their upper ends to a generally imperforate outer liquid container or tub 25. The tub braces 23 are also resiliently connected to the base frame 11 by means of centering springs 26 which resist rotation of the support member 24 relative to the base frame 11 but permit nutational movement relative to the base frame 11.

Revolvably mounted in the imperforate outer tub 25 is a perforate clothes basket or inner tub 29 in which is positoned an oscillatable agitator 30 for effecting movement of fabrics and washing liquid within the tub assembly 22. The imperforate outer tub 25 and the perforate inner tub 29 are substantially aligned with the loading opening 19 in the top cover 15 for permitting the operator to place fabrics within the inner tub 29 to remove them upon completion of the cycle.

The base frame 11 also supports, through a motor mount, a reversible drive motor 31 operable in a bidirectional drive system for selectively effecting oscillation of the agitator 30 or centrifugal rotation of the inner tub 29.

Operation of the motor 31 in a first direction effects rotation of a main drive pulley (not shown) for effecting oscillation of the agitator 30 through a drive shaft (not shown) and transmission gearing. Operation of the motor 31 in the opposite direction effects rotation of the drive pulley (not shown) and the transmission through a clutch (not shown) for rotating the inner tub 29 to effect centrifugal extraction of liquid from fabrics within the inner tub 29.

The washing machine 10 is provided with controls for programming the machine 10 through a sequence of operations including energization of the motor 31 for operation in a first direction to effect a washing and/or rinsing function followed by energization of the motor 31 in a second direction to effect a liquid extraction function.

The construction and mounting of the tub assembly 22 and the operation of the inner tub 29 and agitator 30 for effecting washing and extraction operations are more clearly and specifically shown in the following patents, each of which is assigned to the assignee of the instant invention: Scott et al U.S. Pat. No. 2,854,297; Smith et al U.S. Pat. No. 2,926,136; Burkland U.S. Pat. No. 25,157; and Goodlaxson U.S. Pat. No. 3,013,645. The pumping system in these patents, however, differs from the system described herein since these patents all describe a system in which the pumping means is operatively connected to the reversible drive motor 31 for pumping during the extraction portion of the cycle of operations.

Figure 3:
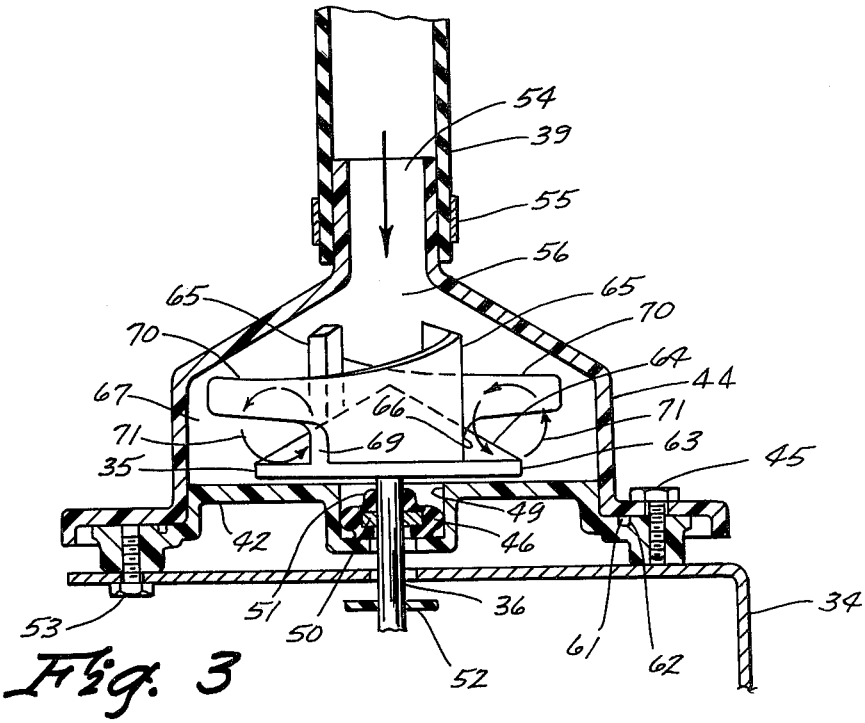
FIG. 3 is a view of the centrifugal pump taken generally along lines 3—3 of FIG. 1.

Referring now to FIGS. 1 and 3, the base frame 11 also supports a pumping means 32 that is directly driven by the pump motor 33. The pumping means 32 is attached to one side of a sheet metal mounting bracket 34 with the motor 33 mounted on the opposite side of the mounting bracket 34 so that the motor 33 is directly coupled to the impeller 35 of the pumping means 32. This coupling is accomplished by threading the end of the motor shaft 36 and molding a mating theaded insert into the plastic impeller 35. As shown in FIG. 1, the pump 32 communicates with the outer tub 25 through a conduit 39 and is operable for carrying liquids from the outer tub 25 and pumping them toward an external drain through a drain hose 40 and standpipe 41.

When pumping soapy washing liquid from the outer tub 25 toward the external drain, air will become trapped in the liquid in the form of soap bubbles. When air does become trapped, the ordinary centrifugal pump, because of its characteristics, will tend to separate the air from the liquid by centrifuging the heavier liquid toward the outer portion of the pump cavity or pumping chamber. This centrifugal action will cause an inner annulus of air or soap bubbles to be formed with an outer annulus of liquid. The air thus trapped in this inner annulus cannot be pumped against the head of water in the conduit and the pump is considered air locked since liquid cannot enter the pump due to the pressure exerted by the air.

FIGS. 1 and 3 show a pumping means 32 assembled to the base frame 11 of the automatic washer 10 through bracket 34. The pump 32 consists of three basic elements: a pump housing 42, a pump impeller 35 and a pump cover 44. The pump housing 42 is secured to the sheet metal mounting bracket 34 by a plurality of threaded fasteners 53. The motor 33 is mounted on the bottom side of the mounting bracket 34 with the motor drive shaft 36 extending through the mounting bracket 34 and into the pump housing 42 where the pump impeller 35 is secured to the motor shaft 36 by turning the impeller 35 onto the threaded end portion of the motor shaft 36. Water leakage through the pump housing 42 at the motor shaft 36 location is restricted by utilizing a three washer seal arrangement inside the pump housing 42 as shown in FIG. 3. A first resilient washer 46 seals the periphery of the opening 49 in the pump housing 42. A stainless steel washer 50 is located in the center of the first resilient washer 46. A second resilient washer 51 surrounds the motor shaft 36 and contacts the stainless steel washer 50 to provide a seal between the motor shaft 36 and the stainless steel washer 50. If small amounts of liquid should leak past this seal arrangement, a slinger washer 52 also formed of a resilient material is located on the motor shaft 36 between the mounting bracket 34 and the motor 33 to sling liquid outward and away from the motor 33.

Figure 2:
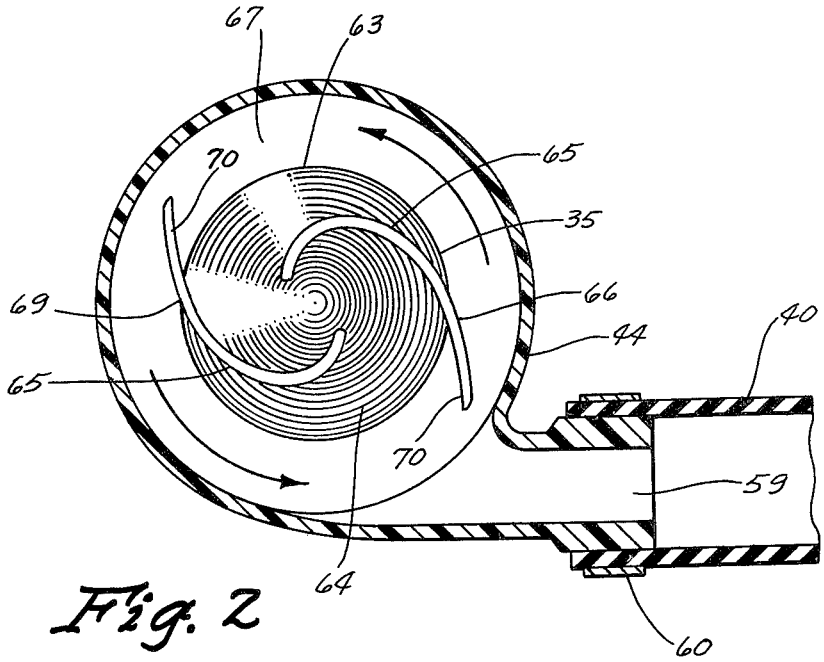
FIG. 2 is a sectional view of the centrifugal pump taken along lines 2—2 of FIG. 1.

The pump cover 44 assembles onto the pump housing 42 with threaded fasteners 45 as shown in FIG. 3 and has an inlet 54 at the top center generally coaxial with the pump impeller 35. The inlet 54 communicates with the outer tub 25 of the machine 10 through a conduit 39 which is secured to the pump cover 44 by a clamp 55. From the inlet 54, the pump cover 44 tapers outward uniformly around the circumference to a diameter greater than the impeller 35 diameter to form a pump chamber 56 as shown in FIG. 3. At this diameter, a pump outlet 59 is located at substantially 90 degrees to the pump inlet 54 which communicates with the external drain through the drain hose or conduit 40 secured by the clamp 60 as best shown in FIG. 2. As shown in FIG. 3, a gasket 61 having a square cross section and located in a groove 62 in the pump housing 42 seals the periphery where the pump cover 44 and pump housing 42 are joined.

FIGS. 2 and 3 show the construction of the impeller 35. As best shown in FIG. 3, the impeller body tapers uniformly upward from the base 63 to form a cone 64. Spaced equally around this cone 64 are two curved impeller blades 65. At points 66 and 69 where the impeller blades 65 would normally stop, a fingerlike projection or extension 70 is continued beyond the body diameter of the impeller 35. The outer periphery of the impeller base 63 is spaced inwardly from the periphery of the pump cover 44 to define an annular outer chamber portion 67. Though the projection or extension 70 is generally a continuation of the blade 65, both as to the view in FIG. 2 and as to the top edge in FIG. 3, the lower edge of the extension 70 is effectively formed by axially cutting away the lower portion of the extension outside of the base periphery so as to comprise a projecting element 70 having an axially reduced section or dimension relative to the axial dimension of the impeller blade at a point adjacent the periphery of the base. As shown in FIG. 2, these projections 70 extend into the outer chamber portion 67. Chamber portion 67 is the outermost portion of pump chamber 56.

In operation, as the pump impeller 35 rotates in the direction of arrows in FIG. 2, liquid is drawn through the inlet 54 into the center of the impeller 35 from the tub 25 through conduit 39. This liquid is centrifuged outwardly toward the pump outlet 59 by the impeller blades 65. As the impeller 35 rotates, the blade projections 70 create a turbulence in the liquid at generally 90 degrees to the pumping flow as indicated by the arrows 71 in FIG. 3. This turbulence causes some of the liquid to be drawn toward the center of the impeller 35 and provides a constant mixing of incoming and centrifuged liquid so that if air is introduced into the pump 32 it will be mixed with liquid and centrifuged toward the pump outlet 59 and the external drain.

It can therefore be seen that the centrifugal pump system disclosed herein offers a unique construction for preventing or alleviating air lock. While the system disclosed permits the use of a centrifugal pump in conjunction with an automatic washing machine 10 without fear of incomplete draining due to air lock, this system can be readily utilized in any centrifugal pumping application where air lock could be encountered.

In the drawings and specification there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

I claim:

1. A centrifugal pump apparatus comprising: pump housing means defining a pump chamber having a liquid ingress and a liquid egress; impeller means having at least one blade and operatively disposed within said pump chamber for moving liquid from said ingress to said egress; pump drive means for operating said impeller means; means for mounting said housing means and said pump drive means in operative association; and a projection on said impeller means, said projection having an axially reduced dimension relative to the axial dimension of said blade and extending outwardly beyond said blade into an outermost portion of said pump chamber for cutting through said liquid in said outermost chamber portion and creating a turbulence in said liquid to achieve a mixing of said liquid with air in an inner portion of said pump chamber whereby an airlock condition is prevented.

2. A centrifugal pump apparatus as defined in claim 1 wherein said impeller means includes a base having an outer periphery spaced from said housing means to define a generally annular outermost chamber portion.

3. A centrifugal pump apparatus comprising: pump housing means defining a pump chamber having a liquid ingress and a liquid egress; impeller means disposed within said chamber and including a base having an outer periphery spaced from said housing means to define a generally annular outermost chamber portion, said impeller means including at least one blade on said base and operable for imparting energy to said liquid and effecting centrifugal movement of said liquid toward the outer periphery of said outermost chamber portion and for moving said liquid from said liquid ingress toward said liquid egress; pump drive means for operating said impeller means; means for mounting said pump housing means and said pump drive means in operative association; and a projection on said blade having an axially reduced dimension relative to the axial dimension of said blade and extending outwardly from said blade into said outermost chamber portion for cutting through said liquid in said outermost chamber portion and creating a turbulence in said liquid to achieve a mixing of said liquid with air in an inner portion of said pump chamber whereby an air accumulation adjacent said impeller and an airlock condition are prevented.

4. A centrifugal pump apparatus as defined in claim 3 wherein said liquid ingress is generally coaxial with said impeller means.

5. A centrifugal pump apparatus as defined in claim 3 wherein said liquid ingress and liquid egress are angularly spaced apart by substantially ninety degrees.

6. A centrifugal pump apparatus as defined in claim 3 wherein said pump drive means includes a drive shaft extending into said pump chamber and directly coupled to said impeller means.

7. A centrifugal pump apparatus comprising: pump housing means defining a pump chamber having a liquid ingress and a liquid egress at a generally right angle to said liquid ingress; impeller means disposed within said chamber in coaxial alignment with said liquid ingress and including a base having an outer periphery spaced from said housing means to define a generally annular outermost chamber portion, said impeller means including at least one blade on said base and operable for imparting energy to said liquid and effecting centrifugal movement of said liquid toward the outer periphery of said outermost chamber portion and for moving said liquid from said liquid ingress toward said liquid egress; pump drive means including a drive shaft extending into said pump chamber and directly coupled to said impeller for operating said impeller means; means for mounting said pump housing means and said pump drive means in operative association; and a fingerlike projection on said blade having an axially reduced dimension relative to the axial dimension of said blade and extending outwardly from said blade into said outermost chamber portion for cutting through said liquid in said outermost chamber portion and creating a turbulence in said liquid to draw a portion of said liquid from said outermost chamber portion into said impeller means to achieve a continual mixing of said liquid with air in an inner portion of said pump chamber whereby an airlock condition is prevented.

8. A centrifugal pump apparatus as defined in claim 7 wherein said fingerlike projection trails said blade through said liquid.

9. A centrifugal pump apparatus as defined in claim 7 wherein said impeller means includes a pair of blades each including said fingerlike projection.

10. A centrifugal pump apparatus as defined in claim 7 wherein said impeller means has a substantially conical surface tapering uniformly upward from said base to an apex.

11. In a laundry apparatus, the combination comprising: a container for receiving and containing washing liquid, a basket disposed within said container for receiving fabrics to be washed and centrifugally rotatable for removing liquids from said fabrics; means for washing sand fabrics in said basket; centrifugal pump means including housing means defining a pump chamber having a liquid ingress communicating with said container and a liquid egress; impeller means disposed within said chamber in coaxial alignment with said liquid ingress and including a base having an outer periphery spaced from said housing means to define a generally annular outermost chamber portion, said impeller means including at least one blade on said base and operable for imparting energy to said liquid and inducing movement of said liquid from said liquid ingress toward said liquid egress; pump drive means for operating said impeller means; means for mounting said pump housing means and said pump drive means to said laundry apparatus in operative association; and a fingerlike projection on said blade having an axially reduced dimension relative to the axial dimension of said blade and extending outwardly from said blade into said outermost chamber portion for cutting through said liquid in said outermost chamber portion and creating a turbulence in said liquid to draw a portion of said liquid from said outermost chamber portion into said impeller means to constantly mix incoming and centrifuged liquid in an inner portion of said pump chamber for alleviating airlock conditions in said pump.

* * * * *